US007390103B2

(12) United States Patent
Chang

(10) Patent No.: US 7,390,103 B2
(45) Date of Patent: Jun. 24, 2008

(54) VIBRATING AND TWINKLING DEVICE

(76) Inventor: Hung-Hua Chang, 3F. No. 238, Baoping Rd., Yonghe City, Taipei County (TW)

( * ) Notice: Subject to any disclaimer, the term of this patent is extended or adjusted under 35 U.S.C. 154(b) by 0 days.

(21) Appl. No.: 11/723,051

(22) Filed: Mar. 16, 2007

(65) Prior Publication Data

US 2008/0106889 A1 May 8, 2008

(30) Foreign Application Priority Data

Nov. 2, 2006 (CN) ..... 2006 1 0138026

(51) Int. Cl.
*F21V 33/00* (2006.01)

(52) U.S. Cl. ..... 362/154; 362/806; 362/157

(58) Field of Classification Search ..... 362/109, 362/253, 806

See application file for complete search history.

(56) References Cited

U.S. PATENT DOCUMENTS 6,135,606 A * 10/2000 Fernandez et al. ..... 362/109

* cited by examiner

*Primary Examiner*—Anabel M Ton
(74) *Attorney, Agent, or Firm*—Rosenberg, Klein & Lee

(57) ABSTRACT

A vibrating and twinkling device which may mounted upon an appearance member for stationery or textile products includes a circuit element, light emitting diodes, power supplies, a vibrating switch, and a transparent encapsulation body. The circuit element includes a circuit board and a circuit control element. The light emitting diodes are mounted on and electrically connected to the circuit board. The power supplies electrically connect with the circuit element for supplying power. The vibrating switch electrically connects to the circuit board. The transparent encapsulation body covers the circuit element, the light emitting diodes, the power supplies, and the vibrating switch. Thereby, the vibrating and twinkling device is waterproof. When the vibrating switch is vibrated, the light emitting diodes can be driven to glow and twinkle, which offers splendid effects when the stationery or textile product is used.

13 Claims, 8 Drawing Sheets

VIBRATING AND TWINKLING DEVICE

BACKGROUND OF THE INVENTION

1. Field of the Invention

The present invention relates to a vibrating and twinkling device, and more especially to a vibrating and twinkling device for stationery or textile products.

2. Description of the Prior Art

People's curiosity of pursuing new things prompts them to try to change their lives and experience all kinds of distinctive feelings. Shoes with vibrating and twinkling devices have the effects of attracting the attention of people due to the glow and twinkle as the wearer walks.

However, as the novelty wears off, shoes with vibrating and twinkling devices become passe and unfashionable. Furthermore, with the development of technology, related industries are pursuing the objectives of improving the vibrating and twinkling device structure and application to allow the vibrating and twinkling devices to be used in things other than shoes. Additionally, it is worth mentioning that most vibrating switches for the vibrating and twinkling devices make the circuits conduct via swinging contact of springs mounted inside the shoe. If the amplitude of vibration of the vibrating switches is too small, the circuits will not conduct and produce twinkling effects.

Hence, the inventors of the present invention believe that the shortcomings described above are able to be improved and finally suggest the present invention which is of a reasonable design and is an effective improvement based on deep research and thought.

SUMMARY OF THE INVENTION

An object of the present invention is to provide a product with vibrating and twinkling devices, wherein the product is a stationary or textile product and further combines with an appearance member and vibrating and twinkling devices, to make the product more interesting and offer more splendid effects, which meets changeable demands of consumers.

To achieve the above-mentioned object, a stationery or textile product with vibrating and twinkling devices in accordance with the present invention is disclosed. A stationery or textile product with vibrating and twinkling devices includes a main body, an appearance member combined with the main body and vibrating and twinkling devices mounted in the appearance member. The vibrating and twinkling devices include a circuit element including a circuit board which has circuits formed thereon and a circuit control element electrically connecting with the circuits of the circuit board; light emitting diodes mounted on the circuit board and electrically connecting with the circuits of the circuit board; power supplies electrically connecting with the circuit element for supplying power; a vibrating switch which includes a hollow metal element, a metal bead, an insulating element and a metal pole, the metal element electrically connecting with the circuits of the circuit board, two ends of which are an opening end and a sealing end, respectively, the metal bead is movably mounted inside the metal element, the insulating element is mounted in the opening end of the metal element and the metal pole is inserted in the insulating element, one end of which is in the metal element and the other end of which electrically connects with the circuits of the circuit board; and a transparent encapsulation body which covers the circuit element, the light emitting diodes, the power supplies, and the vibrating switch.

The efficacy of the present invention is as follows:

1. Through the encapsulation body encapsulating the circuit element, the light emitting diodes, the power supplies and the vibrating switch, the vibrating and twinkling device is waterproof and effectively protects the mentioned elements;

2. Through the engagement of the metal element and the metal bead and the electrical conductivity of metal, the vibrating switch has a sensitive turn-on effect and ensures that the desired glowing and twinkling actions operate because the amplitude of vibration is large enough;

3. The vibrating and twinkling device offers a wide choice of appearance for users through combining with the appearance member, thereby to meet the changeable demands of people and make the device more interesting and offer splendid effects, To further understand features and technical contents of the present invention, please refer to the following detailed description and drawings related the present invention. However, the drawings are only to be used as references and explanations, not to limit the present invention.

DETAILED DESCRIPTION OF THE INVENTION

Figure 1:
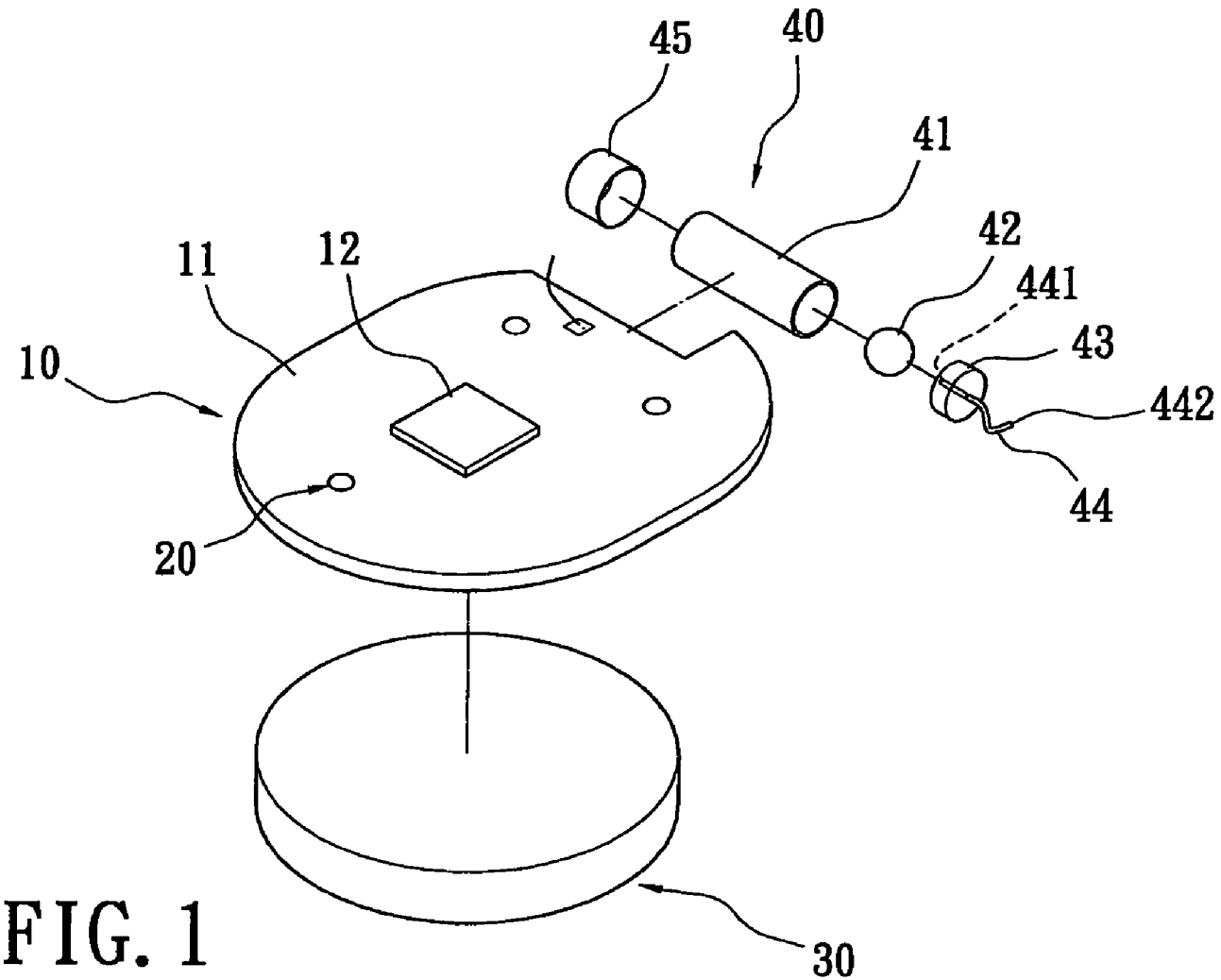
FIG. 1 is an exploded perspective view of a vibrating and twinkling device in accordance with the present invention.
Figure 2:
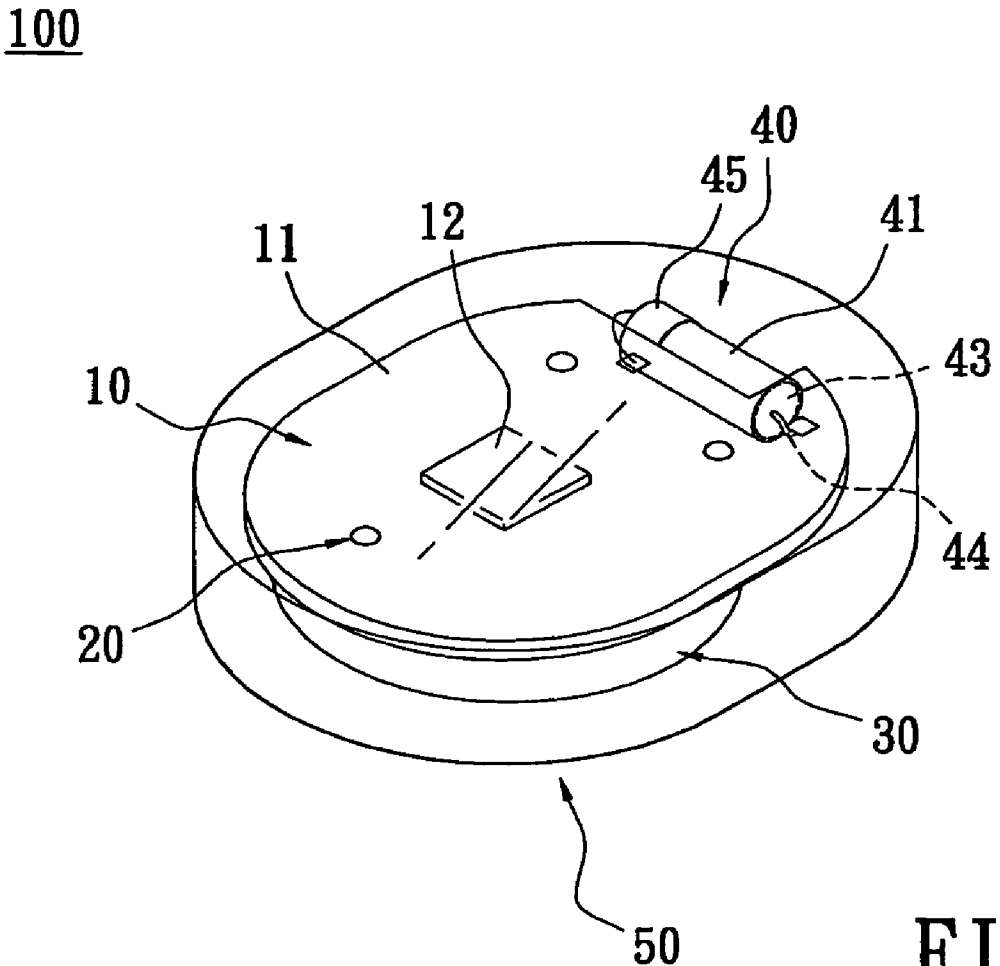
FIG. 2 is an assembled perspective view of the vibrating and twinkling device in accordance with the present invention.

Please referring to FIG. 1 and FIG. 2, w a vibrating and twinkling device 100 in accordance with a preferred embodiment of the present invention is shown. The vibrating and twinkling device 10 includes a circuit element 10, at least one light emitting diode (LED) 20, at least one power supply 30, a vibrating switch 40, and an encapsulation body 50.

The circuit element 10 includes a circuit board (PCB) 11 and a circuit control element (IC) 12. The circuit board 11 has some circuits (not shown) formed thereon. The circuit control element 12 is mounted on the circuit board 11 and electrically connects with the circuits of the circuit board 11. The LEDs 20 are mounted on the circuit board 11 and electrically connect with the circuits of the circuit board 11. The vibrating and twinkling device 10 may have one LED or a plurality of LEDs based upon actual demand. The LEDs 20 may be multi-color LEDs, single color LEDs, or a combination thereof. Furthermore, a multi-color LED 20 consists of a plurality of different colored light-emitting chips (not shown) and may emit multi-colored light. A single color LED 20 consists of a single colored light-emitting chip and may emit a single colored light. The power supplies 30 may be batteries, such as lithium batteries, etc., and are mounted on and electrically connect with the circuit board 11 for supplying power.

The vibrating switch 40 includes a hollow metal element 41, a metal bead 42, an insulating element 43, and a metal pole 44. The metal element 41 is shaped like a cylinder, one end of which is an opening end and the other end of which is a sealing end. The sealing end of the metal element 41 is formed by a metal cover 45 sheathing an outside of the metal element 41 or integrally formed by metal. The metal bead 42 is movably received inside the metal element 41. Additionally, the metal element 41 electrically connects with the circuits of the circuit board 11 by welding directly or by conducting wires or metal wires, etc.

The insulating element 43 is made of insulating material such as plastic and is mounted in the opening end of the metal element 41. The metal pole 44 is inserted in the insulating element 43 and has a contacting end 441 extending into the metal element 41 and a connecting end 442 which is opposite to the contacting end 441, extends out of the insulating element 43, and electrically connects with the circuits of the circuit board 11.

When the vibrating switch 40 is vibrated, the metal bead 42 inside the metal element 41 contacts the contacting end 441 of the metal pole 44 and the metal element 41 simultaneously. Thereby the circuits of the circuit board conduct and induce the LEDs to glow and twinkle. The metal element 41, the metal bead 42, the metal cover 45, and the metal pole 44 further have metal conductive layers by electroplating on surfaces thereof for improving electrical conductivity. It is worth mentioning that the metal element 41 and the metal cover 45 are combined together, which is convenient for an inner face of the metal element 41 being electroplated with a uniform metal conductive layer.

The encapsulation body 50 is made of a transparent material and covers the circuit element 10, the power supplies 30, the LEDs 20, and the vibrating switch 40. The encapsulation body 50 encapsulates the former elements by injection molding, thereby the vibrating and twinkling device 100 is waterproof and can effectively protect the former elements.

Accordingly, when the vibrating and twinkling device 100 is placed perpendicularly and upwardly, the metal bead 42 rolls and is against the metal pole 44. Due to the engagement of the metal element 41 and the metal bead 42 and electrical conductivity of metal, the vibrating and twinkling device turns on easily and ensures that the desired glowing and twinkling actions occur because the amplitude of vibration is adequate. Additionally, when the vibrating and twinkling device of the present invention is perpendicular upwardly, that is, the metal bead 42 rolls and is against the metal pole 44, the vibrating and twinkling device emits light and twinkles when vibrated, thereby ensuring that the metal bead 42 is not placed horizontally or inversely. It is therefore difficult for the metal pole 44 to roll and the sensitivity, vibration and twinkle is guaranteed when the device is vibrated.

Figure 3:
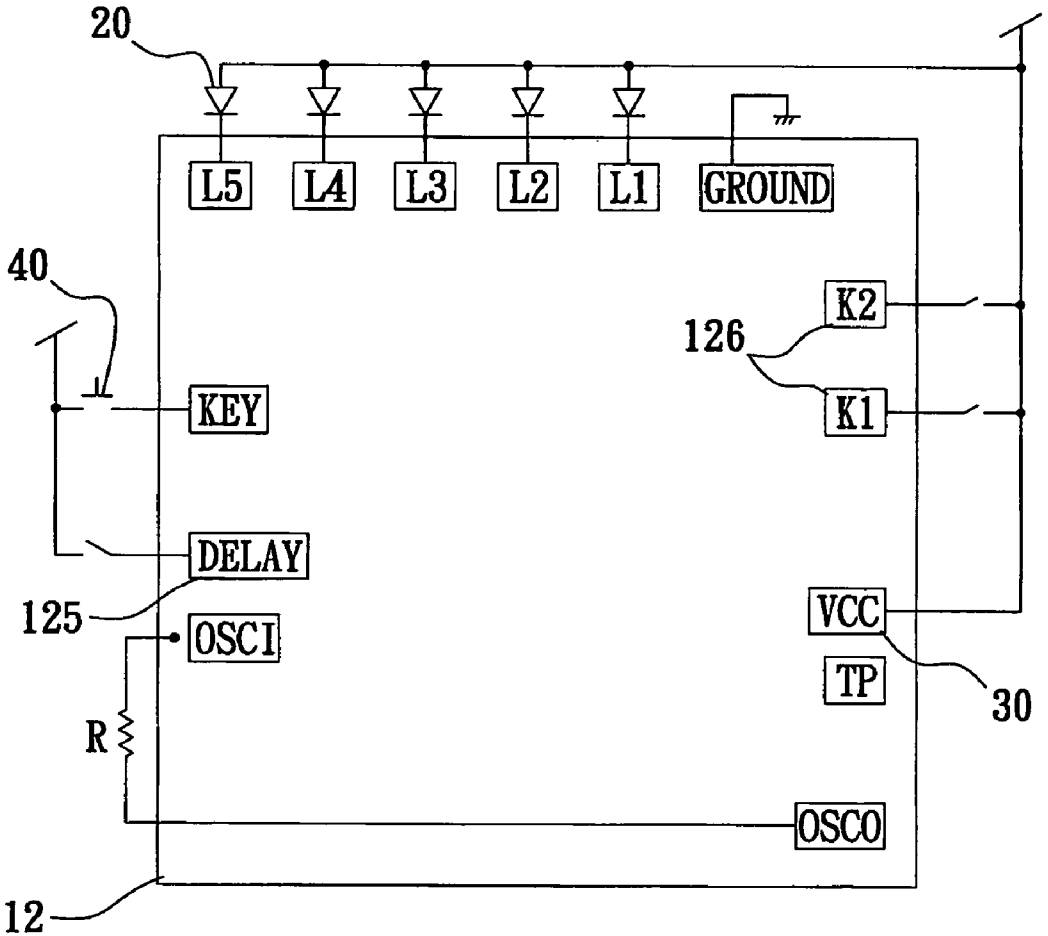
FIG. 3 is a circuit wiring diagram of a circuit control element of the vibrating and twinkling device in accordance with the present invention.
Figure 4:
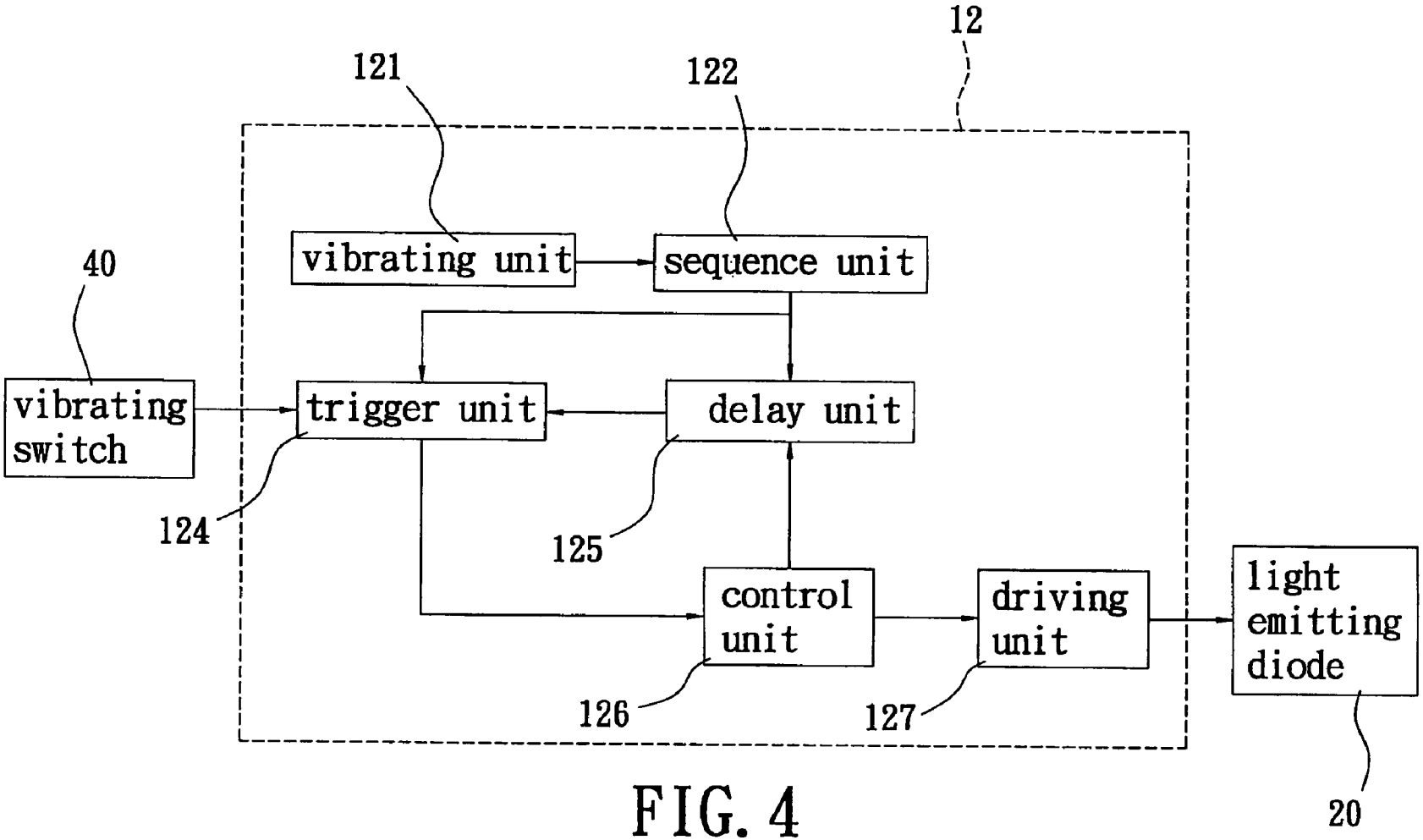
FIG. 4 is a circuit block diagram of the circuit control element of the vibrating and twinkling device in accordance with the present invention.

Please referring to FIG. 3 and FIG. 4. The circuit control element 12 electrically connects with the LEDs 20, the power supplies 30, the vibrating switch 40, and a vibrating resistance R through the circuits of the circuit board (not shown). The circuit control element 12 includes a vibrating unit 121, a sequence unit 122, a trigger unit 124, a delay unit 125, a control unit 126, and a driving unit 127.

The vibrating unit 121 and the sequence unit 122 generate a work frequency for the trigger unit 124 and the delay unit 125. The trigger unit 124 electrically connects with the vibrating switch 40 and generates a trigger signal for the control unit 126 when the vibrating switch 40 is vibrated. The delay unit 125 determines that the circuit control element 12 generates a driving signal and transmits the driving signal to the LEDs 20 within a twinkling time after receiving the trigger signal and disables a new trigger signal which is generated within the twinkling time. After receiving the driving signal from the control unit 126, the driving unit 127 controls and drives the LEDs 20 to glow Accordingly, the trigger unit 124 generates the trigger signal for the control unit 126 when the vibrating switch 40 is vibrated. At this time, the LEDs 20 twinkle in turn within the twinkling time determined by the delay unit 125. When the circuit control element 12 receives the trigger signal the delay unit 125 further controls the circuit control element 12 and generates the driving signal for the LEDs 20 after delaying for a predetermined time set by the delay unit 125. Alternatively, when the twinkling of the LEDs 20 is over and the vibrating switch 40 is vibrated once again, the delay unit 125 controls the trigger unit 124 to generate a trigger signal for the control unit 126 after delaying for a predetermined time. Additionally, the control unit 126 may include two control switches K1, K2. When the control switches K1, K2 work simultaneously, the control unit 126 controls the LEDs 20 to twinkle circularly in turn for n times based on actual demand. When one of the control switches K1, K2 work, the control unit 126 controls the LEDs 20 to twinkle circularly in turn for n±x times based on actual demand. When both the control switches K1, K2 are not working, the control unit 126 controls the LEDs 20 to twinkle circularly in turn for n±y times based on actual demand.

Figure 5:
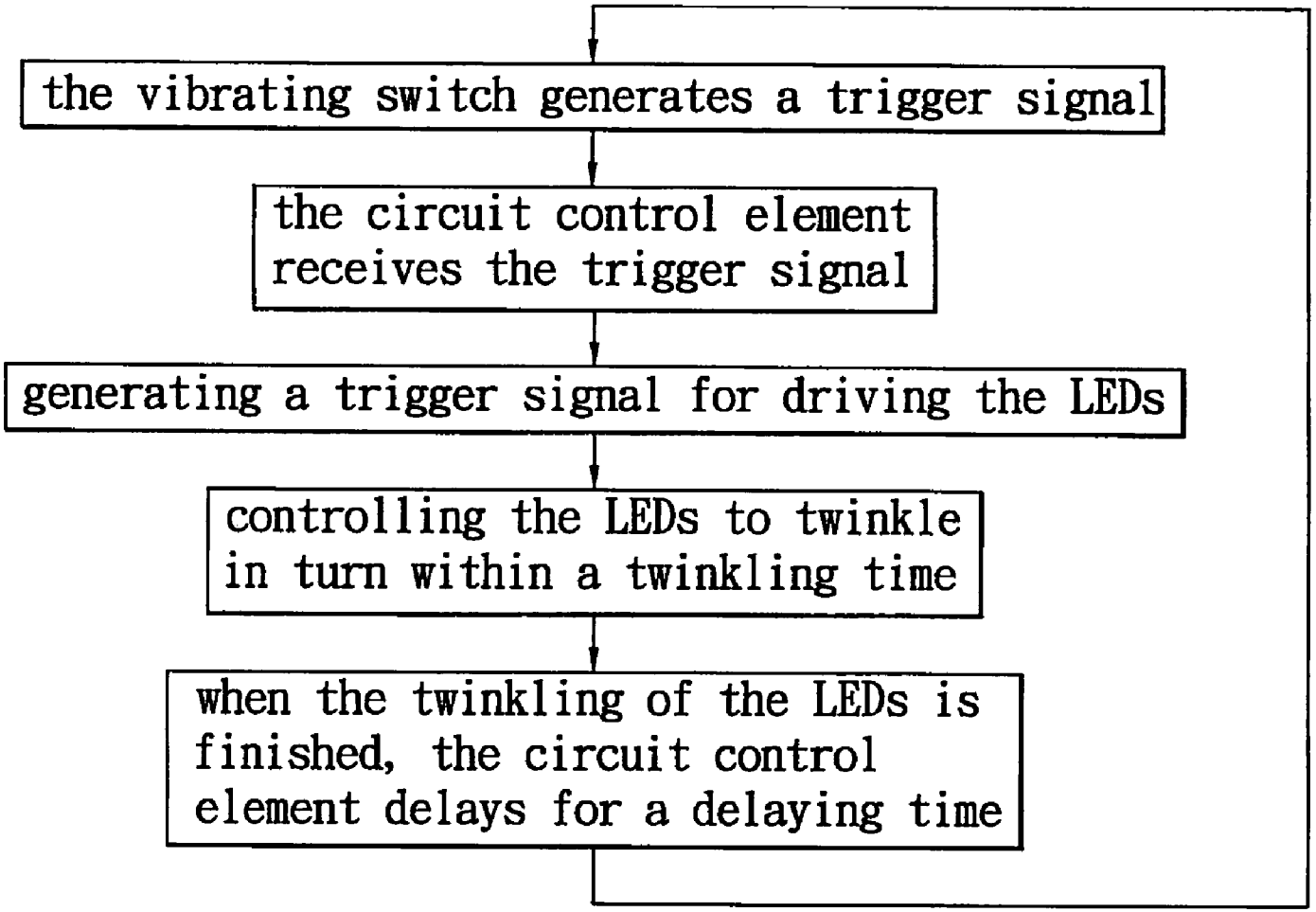
FIG. 5 is a flow chart of the vibrating and twinkling device in accordance with the present invention.

Please referring to FIG. 5 which shows work steps for the vibrating and twinkling device 100 of the present invention. The steps include:

(a). generating a trigger signal when the vibrating switch 40 is vibrated;

(b). the circuit control element 12 receiving the trigger signal;

(c). the circuit control element 12 generating a trigger signal for driving the LEDs to glow;

(d). the circuit control element 12 controlling the LEDs 20 to twinkle in turn within a twinkling time; and (e). when the twinkling of the LEDs 20 is finished, the circuit control element 12 further delays for a predetermined time and if the vibrating switch 40 is vibrated once again, the trigger unit 124 generates a trigger signal for the control unit 126 after the delay time, and then repeats the above steps.

According to the above control method, when the vibrating switch 40 is vibrated, the LEDs 20 are controlled to glow and twinkle in turn after a certain delay time, thereby to offer splendid effects.

Figure 6:
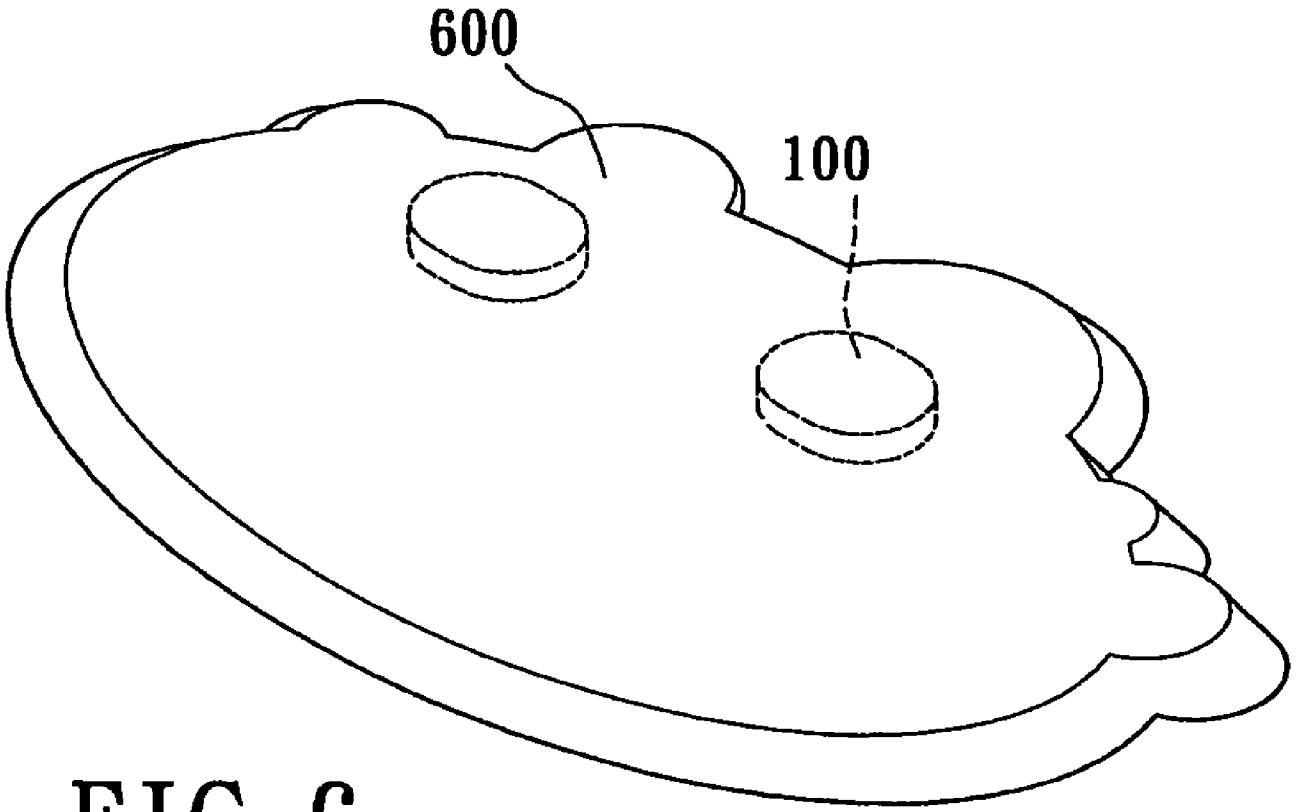
FIG. 6 is a sketched view of the vibrating and twinkling device in accordance with the present invention mounted in an appearance member.

Please referring to FIG. 6 that shows the vibrating and twinkling device 100 mounted in an appearance member 600. The appearance member 600 may arrange one vibrating and twinkling device 100 or a plurality of vibrating and twinkling devices 100 therein based upon actual demand. The appearance element 600 is not limited to a certain shape and may be an animal form or a cartoon character, etc. The appearance member 600 is made of waterproof material such as plastic and is waterproof.

Figure 7:
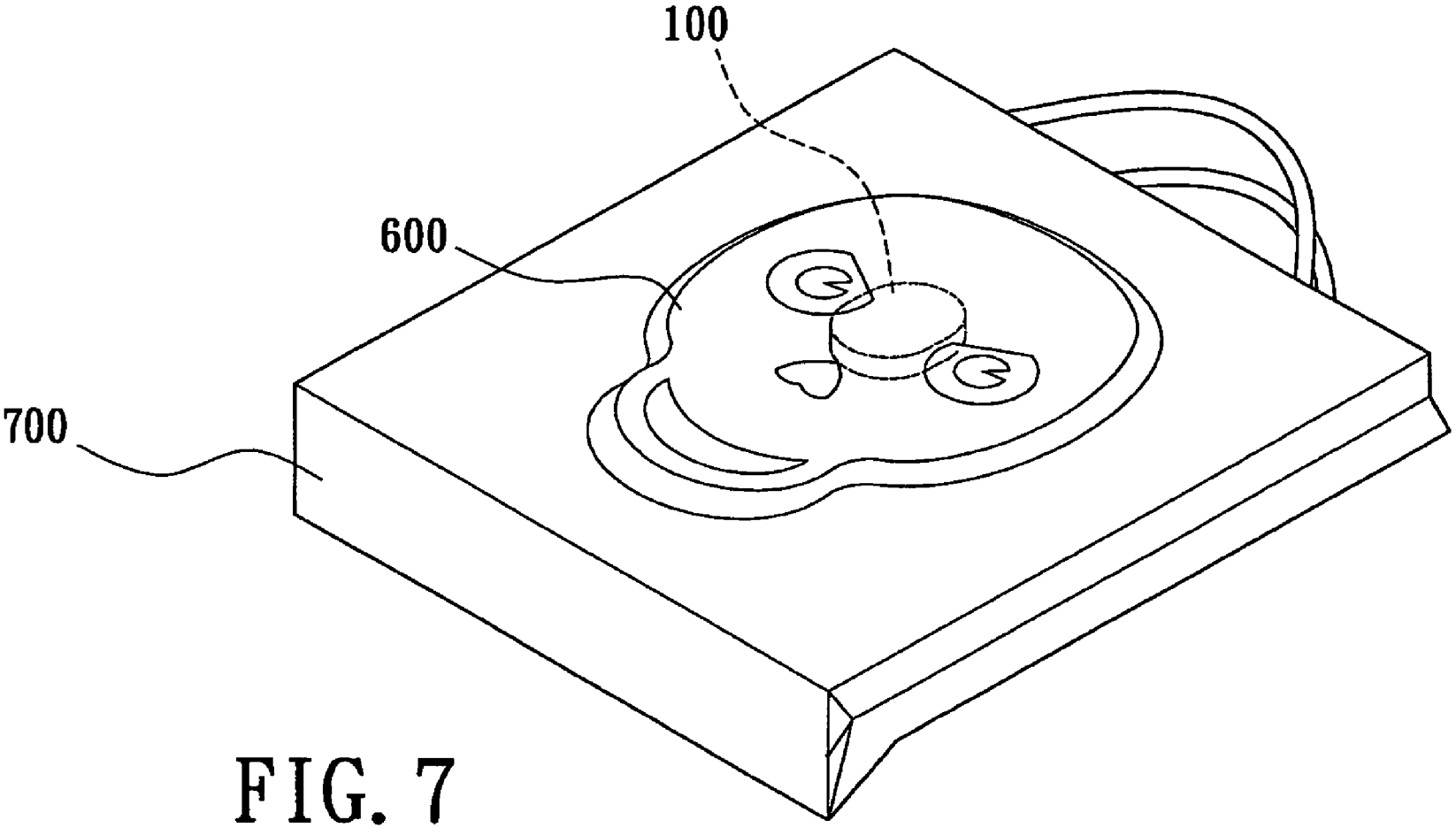
FIG. 7 is a sketched view of the vibrating and twinkling device in accordance with the present invention mounted in the appearance element and a stationery product.
Figure 8:
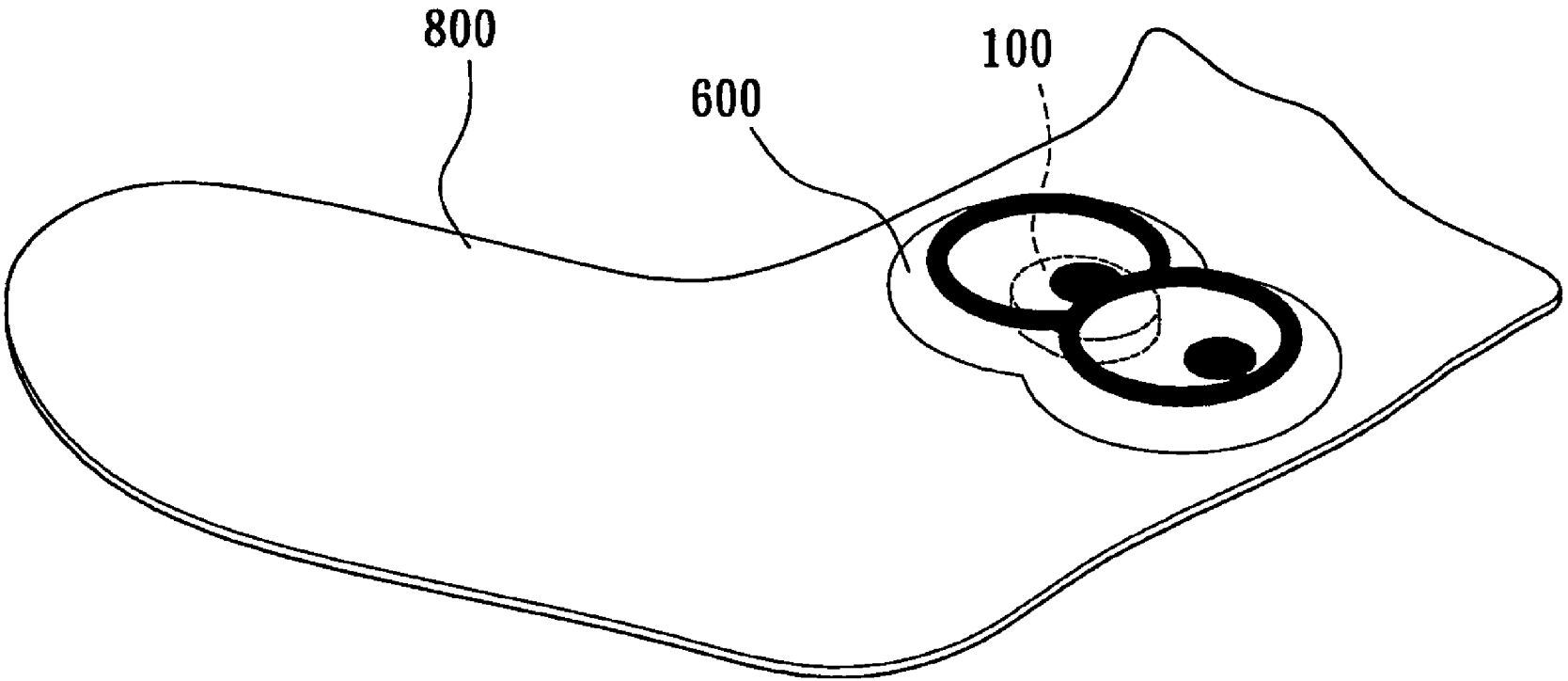
FIG. 8 is a sketched view of the vibrating and twinkling device in accordance with the present invention mounted in the appearance element and a textile product.

The present invention may be combined with a stationery product or a textile product. As shown in FIG. 7, the vibrating and twinkling device 100 and the appearance member 600 of the present invention can be mounted on a main body of a stationery product 700. The stationery product 700 may be a paper bag or a paper booklet, such as a book, a notebook, etc. Furthermore, as shown in FIG. 8, the vibrating and twinkling device 100 and the appearance member 600 of the present invention can be mounted on a main body of the textile product 800. The textile product 800 may be an article of clothing, such as a sock for example. As can be seen, the present invention may combine with an appearance member to offer a wide choice of appearances for users and meet the changeable demands of consumers.

In sum, when users are wearing textile products, LEDs 20 mounted thereon can glow and twinkle as the user moves, which makes the products more interesting and offers splendid effects. The vibrating and twinkling device 100 and the appearance member 600 are waterproof and ensure that the vibrating and twinkling device 100 is not damaged or loses efficacy due to water that comes in contact with the products. Additionally, when a stationery product is being used a small vibration makes the LEDs 20 glow and twinkle in turn, which enhances the enjoyment of using the stationery product.

What is disclosed above is only the preferred embodiment of the present invention and it is therefore not intended that the present invention be limited to the particular embodiments disclosed. It will be understood by those skilled in the art that various equivalent changes may be made depending on the specification and the drawings of present invention without departing from the scope of the present invention.

What is claimed is:

1. A stationery product with vibrating and twinkling devices, comprising:

a main body;

an appearance member, combined with the main body; and at least one vibrating and twinkling device, received in the appearance member, and including:

a circuit element, having a circuit board which has circuits formed thereon and a circuit control element electrically connected with the circuits of the circuit board;

at least one light emitting diode, mounted on the circuit board and electrically connected with the circuits of the circuit board;

at least one power supply, electrically connected with the circuit element for supplying power;

a vibrating switch, including a hollow metal element, a metal bead, an insulating element, and a metal pole, wherein the metal element electrically connects with the circuits of the circuit board and two ends of which are an opening end and a sealing end, respectively, the metal bead is movably mounted inside the metal element, the insulating element is mounted in the opening end of the metal element and the metal pole is inserted in the insulating element, one end of which is in the metal element and the other end of which electrically connects with the circuits of the circuit board; and a transparent encapsulation body, covering the circuit element, the light emitting diodes, the power supplies, and the vibrating switch;

whereby when the vibrating switch is vibrated, when the vibrating and twinkling device is positioned in a vertical plane, the metal bead rolls to and contacts the metal pole to automatically activate the vibration of the device and the twinkling effect of the light emitting diodes, the metal element generates a trigger signal and the circuit control element receives the trigger signal and generates a driving signal to make the light emitting diodes twinkle for a twinkling time, when the vibration and twinkling device is positioned in a horizontal plane, the metal bead rolls away and is removed from contact with the metal pole in order to automatically deactivate the vibration of the device and the twinkling effect of the light emitting diodes.

2. The stationery product with vibrating and twinkling devices as claimed in claim 1, wherein the main body is a bag or a booklet.

3. The stationery product with vibrating and twinkling devices as claimed in claim 1, wherein the appearance member is made of a waterproof material.

4. The stationery product with vibrating and twinkling devices as claimed in claim 1, wherein the circuit control element includes:

a trigger unit, electrically connected with the vibrating switch and generating the trigger signal;

a driving unit, driving the light emitting diodes to glow;

a control unit, receiving the trigger signal and generating the driving signal for the driving unit to make the light emitting diodes twinkle in turn; and a delay unit, determining the twinkling time.

5. The stationery product with vibrating and twinkling devices as claimed in claim 1, wherein the light emitting diodes are multi-colored light emitting diodes, single colored light emitting diodes or a combination thereof.

6. The stationery product with vibrating and twinkling devices as claimed in claim 1, wherein the sealing end of the metal element is formed by a metal cover sheathing an outside of the metal element.

7. The stationery product with vibrating and twinkling devices as claimed in claim 1, wherein the trigger signal generated in the twinkling time is disabled by the circuit control element.

8. A textile product with vibrating and twinkling devices, comprising:

a textile main body;

an appearance member, combined with the main body; and at least one vibrating and twinkling device, received in the appearance member, and including:

a circuit element, including a circuit board which has circuits formed thereon and a circuit control element electrically connected with the circuits of the circuit board;

at least one light emitting diode, mounted on the circuit board and electrically connected with the circuits of the circuit board;

at least one power supply, electrically connected with the circuit element for supplying power;

a vibrating switch, including a hollow metal element, a metal bead, an insulating element and a metal pole, wherein the metal element electrically connects with the circuits of the circuit board and two ends of which are an opening end and a sealing end, respectively, the metal bead is movably mounted inside the metal element, the insulating element is mounted in the opening end of the metal element and the metal pole is inserted in the insulating element, one end of which is in the metal element and the other end of which electrically connects with the circuits of the circuit board; and a transparent encapsulation body, covering the circuit element, the light emitting diodes, the power supplies and the vibrating switch;

whereby when the vibrating switch is vibrated, when the vibrating and twinkling device is positioned in a vertical plane, the metal bead rolls to and contacts the metal pole to automatically activate the vibration of the device and the twinkling effect of the light emitting diodes, the metal element generates a trigger signal and the circuit control element receives the trigger signal and generates a driving signal to make the light emitting diodes twinkle for a twinkling time, when the vibration and twinkling device is positioned in a horizontal plane, the metal bead rolls away and is displaced from the metal pole in order to automatically deactivate the vibration of the device and the twinkling effect of the light emitting diodes.

9. The textile product with vibrating and twinkling devices as claimed in claim 8, wherein the main body is an article of clothing.

10. The textile product with vibrating and twinkling devices as claimed in claim 8, wherein the circuit control element includes:

a trigger unit, electrically connected with the vibrating switch and generating the trigger signal;

a driving unit, driving the light emitting diodes to glow;

a control unit, receiving the trigger signal and generating the driving signal for the driving unit to make the light emitting diodes twinkle in turn; and a delay unit, determining the twinkling time.

11. The textile product with vibrating and twinkling devices as claimed in claim 8, wherein the light emitting diodes are multi-colored light emitting diodes, single colored light emitting diodes or a combination thereof.

12. The textile product with vibrating and twinkling devices as claimed in claim 8, wherein the sealing end of the metal element is formed by a metal cover sheathing an outside of the metal element.

13. The textile product with vibrating and twinkling devices as claimed in claim 8, wherein the trigger signal generating the twinkling time is disabled by the circuit control element.

* * * * *